United States Patent [19]

Csicsery

[11] 3,933,130

[45] Jan. 20, 1976

[54] FUEL INJECTION COLD START AND EVAPORATIVE CONTROL SYSTEM USING A BIMODAL ADSORBENT BED

[75] Inventor: Sigmund M. Csicsery, Lafayette, Calif.

[73] Assignee: Chevron Research Company, San Francisco, Calif.

[22] Filed: Mar. 6, 1974

[21] Appl. No.: 448,775

Related U.S. Application Data

[63] Continuation-in-part of Ser. No. 295,040, Jan. 1, 1974, Pat. No. 3,838,667.

[52] U.S. Cl. ..... 123/3; 123/127; 123/180 R; 123/18 A

[51] Int. Cl.[2] ..... F02M 27/02

[58] Field of Search ..... 123/179 L, 180 R, 180 A, 123/127, 133, 135

[56] References Cited

UNITED STATES PATENTS

| | | | |
|---|---|---|---|
| 3,221,724 | 12/1965 | Wentworth | 123/136 |
| 3,635,200 | 1/1972 | Rundell et al. | 123/119 E X |
| 3,826,237 | 7/1974 | Csicsery et al. | 123/3 X |
| 3,838,667 | 10/1974 | Csicsery | 123/3 |

*Primary Examiner*—Charles J. Myhre
*Assistant Examiner*—James D. Liles
*Attorney, Agent, or Firm*—J. A. Buchanan, Jr.; H. D. Messner

[57] ABSTRACT

As cold start is initiated in a spark-ignition internal, fuel injection combustion engine, lower molecular weight constituents fo a full-range gasoline are selectively eluted by an elution system including an adsorbent bed of adsorbent material (cold start cycle). Under such circumstances, the adsorbent bed forms an elution zone within a cannister assembly. Entry of the full-range gasoline is initiated by a valve and conduit network under control of a fuel injection control circuit. Furthermore, when the engine is in an inoperative state (vapor capture cycle) the same adsorbent bed is also capable of performing a second function: it adsorbes evaparative emissions originating from within the gasoline tank.

9 Claims, 9 Drawing Figures

FUEL INJECTION COLD START AND EVAPORATIVE CONTROL SYSTEM USING A BIMODAL ADSORBENT BED

Furthermore, the subject application is a continuation-in-part of Ser. No. 295,040 now U.S. Pat. No. 3,838,667 for "Fuel Injection Cold Start and Evaporative Control Method and Apparatus for Carrying Out Same" filed Oct. 4, 1972, now U.S. Pat. No. 3,838,667, issued Oct. 1, 1974.

RELATED APPLICATIONS

Other applications assigned to the assignee of the subject application containing common subject matter incorporated herein by reference, include:

| Title | | Serial No. |
|---|---|---|
| Two-Stage Cold Start and Evaporative Control System and Apparatus for Carrying Out Same | Sigmund M. Csicsery and Bernard F. Mulaskey | 295,029 Filed 10-4-72 now P.N. 3,838,673 |
| Cold Start Method and Apparatus for Carrying Out Same | John F. Senger | 295,041 Filed 10-4-72 |
| Single Stage Cold Start and Evaporative Control Method and Apparatus for Carrying Out Same | Sigmund M. Csicsery | 295,028 Filed 10-4-72 now P.N. 3,831,572 |
| Two-Stage Fuel Injection Cold Start Method and Apparatus for Carrying Out Same | Sigmund M. Csicsery and Bernard F. Mulaskey | 295,030 Filed 10-4-72 now P.N. 3,826,237 |
| Single Stage Cold Start and Evaporative Control Method Using a Bimodal Adsorbent Bed | Sigmund M. Csicsery | 448,773 |

BACKGROUND OF THE INVENTION

The present invention relates to cold starting and evaporative emission control of a spark-ignition, fuel injection internal combustion engine and has for an object the provision of a simple and effective cold start and evaporative control system for use in such engine i. for selectively eluting from a full range fuel flowing to the engine, only the lower molecular weight constituents at cold start so as to allow quick starting of the engine without excessive amounts of unburned hydrocarbons appearing at the exhaust (cold start cycle) as well as ii. for adsorbing evaporative emissions from the gasoline tank when the engine is not operating (vapor capture cycle), without mileage loss.

Higher molecular weight constituents adsorbed during the cold start cycle and/or light, evaporative emissions adsorbed during the vapor capture cycle of the engine are subsequently purged from the engine, by consumption interior thereof, but only after the engine has warmed and full range fuel is being utilized.

In my parent application cited above, I taught how cold starting of a spark-ignition, fuel injection internal combustion engine could be enhanced, such enhancement occurring without generating unburned hydrocarbons at the engine's exhaust. Specifically, as cold start conditions occur (cold start operating mode), just enough lower molecular weight constituents of a full-range fuel can be dynamically eluted for cold starting of the engine. The described elution system includes an adsorbent bed of adsorbent material packed within a cannister assembly. Fuel flow control from a fuel reservoir is by means of a controller circuit acting through a valve and conduit network. Initiation of the cold start cycle is straight-forward, as by means of a change in state of the ignition switch. In addition to the aforementioned cold start capabilities, my system also has the added feature of being able to adsorb evaporative emissions originating from within the gasoline tank when the engine is inoperative, such emission capture occurring not within the above-identified adsorbent bed, but within a second adsorbent bed located coextensively with, but coaxially exterior thereof. However, since the cannister assembly supporting both first and second beds had to include an internal separation wall, experience has shown that the resulting cannister assembly could be rather costly and time-consuming to fabricate.

In accordance with the present invention, rather than requiring complex, double-wall construction, my cannister assembly now requires only a single adsorbent bed for performing the aforementioned dual functions. Thus in one embodiment, the cannister assembly uses only a single unitary sidewall to form the annular support space at its interior. Into the unitary space adsorbent materials are packed capable of interchangeably functioning as either an elution or emission capture adsorbent bed. Inasmuch as the two separate functions are interchangeable, it is essential that the adsorbent material (constituting the aforementioned adsorbent bed) be properly classified for these functions, viz, either polar or nonpolar or a combination thereof.

In many applications, a composite mixture of polar and nonpolar adsorbent materials is preferred. The range of the mix ratio, by volume, can be varied depending upon the nature of conditions encountered in the field. That is, in geographically humid zones of the world, such as found in the sourthern part of the United States, there may be a requirement for the use of greater amounts, by volume, of the nonpolar adsorbent constituent material for the purpose of increasing capture area of the cannister assembly. Results: increased probability of total adsorption of vapor emissions generated within the fuel system. Similarly, in colder climatic zones where start conditions are more severe, there may be some advantage to provide greater amounts of polar adsorbent material during the cold start cycle of the engine. The key requirement in both cases, of course, remains to provide polar and nonpolar adsorbent constituent materials in a combination that assures both efficient elution and capture modes of operation within the cannister assembly of the present invention.

Construction of the improved cannister assembly in accordance with present invention can vary. For example, in one embodiment a simple cylinder can be plugged at both ends with solid, annular pole pieces. Entry and egress of the engine fuel is by means of radially extending fittings connected through the valve and conduit network to the fuel reservoir.

All operating cycles are automatically controlled through a fuel injection control circuit similar to one I previously proposed and described in the above-identified parent application. The fuel injection control circuit, in turn, acts in conjunction with the valve and conduit network to allow (or prevent) fluid flow, depending on the operating cycle.

In more detail, during the cold start cycle, the valve and conduit network is arranged to allow free passage of the full-range fuel into contact with the adsorbent bed say through a radial inlet fitting and thence by percolation thereover. Selective retardation of the higher molecular weight compounds, vis-a-vis the lower components then occurs. Thereafter, the latter constituents pass from a second radial outlet fitting to each of a series of electromagnetic injectors in a preselected time sequence, as well as in a preselected air-fuel ratio. Results: the engine starts even under the most severe climatic conditions. Since the starting cycle is usually quite short, say from 1 to 15 seconds, the residence time for the high molecular weight compounds within the elution zone is preferably 1 to 2 orders longer say from 1 to 3 minutes. Thus, the heavier compounds remain selectively adsorbed with the adsorbent bed during starting of the engine. Thereafter, the adsorbent bed is disconnected from direct fuel flow by the controller. The full-range fuel from the reservoir, then is forced to flow in a direct path to the electromagnetic injectors. As the full-range fuel is used and the cannister is disabled, it should be noted that the latter undergoes depressurization. Result: as the engine warms and hot air is passed adjacent to the cannister, adsorbed materials (adsorbents) within the adsorbent bed, are easily purged from the system.

In still more detail, during the inoperative state of the engine (the vapor capture cycle), the same adsorbent bed interior of the cannister assembly is automatically placed in fluid contact with the gasoline tank through operation of the same controller and network system. Thus, the evaporative emissions are free to pass into and be captured by the aforementioned adsorbent bed. Since studies indicate that up to 15% by volume of the total vapors admitted into the atmosphere during inoperativeness of I.C. engines are traceable to evaporative emissions originating from fuel sources of such engines, the present invention provides a useful solution to a serious environmental problem.

Since the function of the associated valve and conduit network and the fuel injection control conduit is to place the adsorbent bed of the cannister assembly in fluid flow relationship with relevant elements of the fuel system as required, it is apparent that after the engine has been started and adequately warmed, adsorbates within the adsorbent bed (due to the elution and capture cycles) can be automatically purged from the cannister; gases (either full or partial engine air or manifold exhaust gases) can be passed adjacent to the cannister assembly, as required.

Although the prior art has suggested both polar and nonpolar adsorbent materials for use in enhancing operation of I.C. fuel systems, there has been no suggestion of using commonly housed adsorbent materials in an unitary elution system to serve two functions: (i) selectively eluting from a full-range gasoline, only light, low molecular weight components thereof, to assure a smooth pollution-free start of a spark-ignition fuel injection internal combustion engine while alternatively (ii) providing for capture of evaporative emission originating from the associated fuel system when the engine is in an inoperative state.

Further objects, features and attributes of the present invention will become apparent from a detailed description of several embodiments thereof to be taken in conjunction with the following drawings in which:

DESCRIPTION OF A SPECIFIC EMBODIMENT

Figure 1:
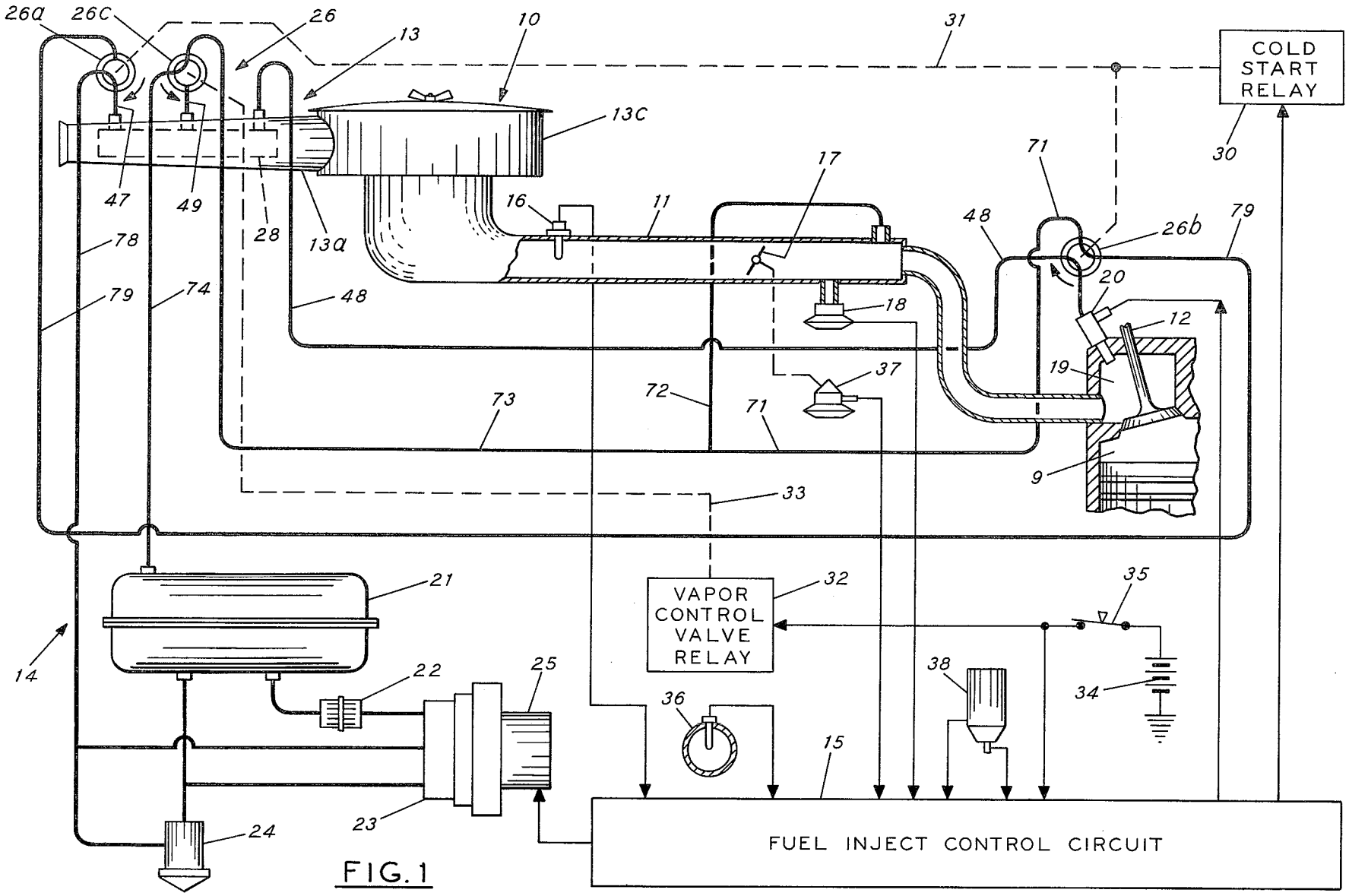
FIG. 1 is a schematic view of a portion of an engine fuel system incorporating the present invention illustrating a typical fuel injection system and air cleaner assembly interconnected between a cold start - evaporative emission system of the present invention, said cold start evaporative control emission system including a cannister assembly housed within the air intake line of the air cleaner assembly under regulation of a valve and conduit network controlled by a fuel injection controller circuit.

Referring now to FIG. 1, there is illustrated a combustion chamber 9 of a spark-ignition, fuel injection I.C. engine connected to a engine fuel system 10 through an engine intake manifold 11. Fuel system 10 of the present invention includes an air intake system 13, a fuel intake system 14, and a fuel injection control circuit 15.

To form a combustible air-fuel mixture, air enters by way of air intake system 13, say by way of air inlet line **13*a*, and is filtered at an air filter interior of an air filter housing 13*c*, before entry into intake manifold 11. Manifold 11 includes air temperature gauge 16, butterfly valve 17, vacuum sensor 18 and a mixing chamber 19 connected to combustion chamber 9 through intake valve 12. Also connected to the mixing chamber 19 adjacent to the intake valve 12 is a fuel injection valve 20. The purpose of the fuel injector valve 20 is to allow a metered quantity of gasoline to be mixed with air passing into mixing chamber 19. The resulting fuel-air mixture passes through intake valve 12 into the engine combustion chamber 9** where combustion occurs.

Supplying mixing chamber 19 with a metered quantity of gasoline is by means of the previously mentioned fuel intake system 14. The fuel intake system 14 includes a gas tank 21 containing a reservoir of full-range fuel (i.e., a full-boiling gasoline), a filter 22, a fuel pump 23 and a pressure regulator 24. Pump 23 is driven through a motor 25 connected to the fuel injector control circuit 15 to pump fuel by way of cold start inlet valve **26*a* of conduit and valve network 26. Valve and conduit network 26 is also seen to also include a cold start exit valve 26*b*, controlled mechanically by cold start relay means 30 through transducer 31. A second relay means 32 is seen to control operation of evaporative emissions control valve 26*c* of valve and conduit network 26 through mechanical transducer 33. Transducers 31 and 33 convert rectilinear travel of the relay means 30 and 32 to rotational motion. However, note that instead of being regulated by control circuit 15, the second relay means 32 is seen to be controlled by ignition switch 35 connected to battery 34. Thus, the condition of ignition switch 35 is directly reflected in operation of the evaporation control valve 26*c* connected to the relay means 32: if the switch 35 is in an "OFF" position, the control valve 26*c* assumes the position depicted in FIG. 9 to allow for capture of evaporative emissions originating within the gas tank 21** as explained in more detail below.

Fuel injection control circuit 15 is seen to be connectable to battery 34 as ignition switch 35 is closed. At that time, the battery 34, itself, is connected to a generator (not shown) in conventional manner, say by way of a regulator.

When ignition switch 35 is closed, as described above, the control circuit 15 becomes operational. Input information thereto is by way of the following transducers: air temperature gauge 16, vacuum sensor 18, engine temperature indicator 36, travel sensor 37, RPM and shaft angle indicator 38. From this data the circuit 15 commands relevant parts of the fuel system 10 using a selected binary code of current pulses (ONE–ZERO), to adapt fuel requirements at the injector valve 20 to changing conditions of operations. That is, in this regard, the period of time of, say the ONE state can be used to indicate the energization period of each of a series of injectors 20, while the ZERO state to indicate the inactivity period of relevant elements of the system.

In more detail, the start of each pulse at a particular injector, say injector number 2 (of 8) is synchronized ("timed") to occur when a particular shaft angle indication is provided by shaft angle-RPM indicator 38. After a pulse has been correctly initiated, its period (pulse width) is basically a function of the manifold pressure (engine load) as provided by vacuum sensor 18. Corrections by which pulse width is stretched or diminished, are a function of data supplied by the remaining sensors, i.e., air intake temperature, engine temperature throttle valve movement and engine speed.

Prior art electronic fuel injection systems have had difficulty in providing fuel requirement at cold start even when using a separate start valve attached to the intake manifold. In this application, a "cold" engine is one which, in attempting to assume an ambient air temperature, has cooled to a temperature below a selected level. This level is empirically determined and is the temperature below which difficulty of starting is increased beyond the usual capability of fuel injection control circuit 15. The present invention provides a cold start function through selective elution of a fuel range gasoline.

For this purpose, a cannister assembly 28 is seen in FIG. 1 to be mounted adjacent to the air intake system 13, say within air inlet line **13*a*. Fuel flow relative to the cannister assembly 28 is selectively controlled, as explained above, to provide suitable fuel components at the injector valves 20, as required by the operating conditions. For example, at cold start, in accordance with the present invention, lower cold start temperature limits for the starting of an internal, final injection combustion engine, are suitably extended through the selective elution of only light, low molecular weight liquid components of the full-range fuel, i.e., a full-boiling gasoline. However, note that at cold start, the full-range fuel, i.e., a full-boiling gasoline, having high and low molecular weight constituents, is conveyed from gas tank 21 through fuel pump 23 into the valve and conduit network 26 and thence to cannister assembly 28. Within cannister assembly 28, the light, lower molecular weight components are generated. Since a key in providing efficient cold starting conditions lies in the selective elution of light, lower molecular weight fuel components, a brief discussion of the cannister assembly 28** seems to be in order and is presented below.

CANNISTER ASSEMBLY 28

Figure 2:
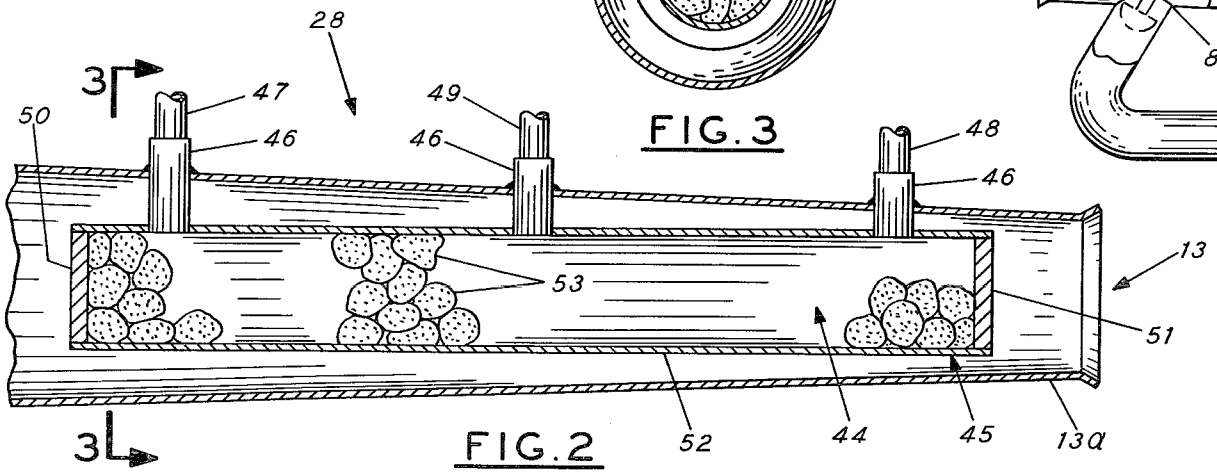
FIG. 2 is a partial cutaway of the cannister assembly of FIG. 1.

Construction of the cannister assembly 28 can vary. In FIG. 2, the cannister assembly 28 is mounted within the intake air line **13*a* of the air intake system 13. It is preferably cylindrical. Its overall diameter must be kept to a minimum so as to allow sufficient air to bypass into the intake manifold of the engine. Within its interior, a bed of adsorbent material indicated at 44 is provided. To accommodate the required volume of the aforeconstituted adsorbent material, the length of cylindrical housing 45 may have to be about as long as the housing of the air line 13*a*. Support of the housing 45 can be brought about by welding anchors 46 to the side wall of the housing of the air line 13*a* through which cold start inlet and outlet fittings 47 and 48 as well as evaporative fitting 49 are attached. End pole pieces 50, 51 are welded at their edges to side wall 52 of the housing 45**.

Each pole piece 50, 51 is a solid annulus having no opening therethrough. Accordingly, flow of intake air exterior of the housing 45 is not allowed to directly mix with fuel continuously flowing through conduit fittings 47 and 48 of the cannister assembly 28. That is, during cold starting of the engine, liquid fuel flowing through the assembly 28 because of the operative condition of valves **26*a* and 26*b* of valve and conduit network 26 (FIG. 1) is not permitted to mix with intake air within the air line 13*a* of the air intake system 13**.

Within the adsorbent bed 44, controlled separation of the full-range fuel occurs so that only light molecular weight liquid constituents are eluted at outlet fitting 48 for subsequent mixing with air to form the cold start air-fuel mixture, at least during initial 1–3 minutes of the cold starting cycle. Since the separation of the heavy molecular weight vis-a-vis light groups is achieved based on the functional characteristics of the adsorbent bed 44 formed within the cannister assembly 28, a brief discussion of adsorption systems in general seems to be in order and is presented below. However, since the adsorbent bed 44 also functions as a vapor emission capture zone when the engine is placed in an inoperative state, i.e., when evaporative control valve 26*c* is in an active condition (FIG. 9), the didactic discussion which follows has been divided along similar lines.

Referring still to FIG. 2, during the cold start cycle, the side wall 52 of the cylindrical housing 45, forms essentially a column of a solution adsorption, frontal analysis chromatography as classified in accordance with Kirk-Othmer Encyclopedia of Chemical Technology, 2nd Ed., Volume 5, page 418. In accordance with Kirk-Othmer op. cit., such classification is essentially based on the nature of the mobile phase of the system percolating through an adsorbent material indicated at 53 in FIG. 2.

Initially full-boiling gasoline enters by way of inlet conduit fitting 47. Thereafter, it percolates through and about the adsorbent bed 44. At the outlet conduit fitting 48, the order of elution is a function of the order of polarity of the constituents of the full range constituents since the individual molecules of the heavier components move at a slower rate (between the mobile and secondary phases) than do the lighter constituents. Intermediate conduit fitting 49 is not free to pass constituents from the adsorbent bed 44 during cold state. As seen in FIG. 1, evaporative control valve 25*c* prevents flow of the gasoline constituents therethrough, since it remains inoperative during the cold start cycle as previously mentioned. Within the interior of the adsorbent bed 44, the causes for separation of the constituents can be for a multiplicity of reasons, inter alia, the polarity (or non-polarity) characteristics of the constituents seem to be a relevant criterion for separation classification in that different relative velocities are thought to be imparted to the individual molecules of the groupings. Accordingly, usually the least strongly adsorbed low molecular weight components elute as a group at the outlet conduit 48 first, followed by a second grouping containing say both the light and heavy molecular weight constituents and so forth until all constituents have appeared.

Residence time of the lighter components within the adsorbent bed 44 is also a function of rather conventional engineering factors including the length of the cylindrical housing 45, as well as the pressure drop of the former during percolation of the fluids over the adsorbent material 53. The flow rate of the mobile phase must be slow enough to allow maximum transfer of the molecules of the heavier constituents into and from the stationary and mobile phases yet fast enough to provide ample amounts of lighter components for quick starting of the engine. However, care ought be exercised in regard to the residence time of the heavier components. Since selective retardation of the heavier constituents due to relative polar-nonpolar interaction between the heavier components and adsorptive material 53, can be quite long, say 1–3 minutes, while the typical starting cycle of a modern engine can be quite short, say from 1 second up to 15 seconds (except when problems of starting occurs), the heavier constituents usually remain adsorbed during starting. This conclusion assumes, of course, that the composite adsorbent material 53 constituting the adsorbent bed 44 is of a compatible classification to perform both elution and vapor capture functions as discussed below.

Classification of Adsorbent Material 53

As previously mentioned, during elution of low molecular weight liquid fuel constituents, competition for the heavier molecular weight groupings of the full-range fuel is believed to be, more or less, dependent on its selective polar interaction with the adsorptive material 53 constituting the adsorbent bed 44. The degree of interaction, in most, but not all cases, is believed to be directly related to the magnitude of the polarity of the material. The general rule seems to be the greater the polarity, the greater the interaction. Thus, in accordance with the present invention, the adsorptive material 53 should have (preferably in addition to a nonpolar constituent, for reasons explained below) a polar element, say one selected from the following non-exclusive listing of popular polar adsorptive materials for proper operation as a cold start fuel effluent generator:

| Polar Adsorptive Materials | Remarks |
|---|---|
| Silica gel | |
| Alumina | Activated Preferred |
| Alumina gel | |
| Barium sulfate | |
| Fuller's earth | |
| Calcium carbonate | |
| Bentonite | |
| Glass | |
| Diatomaceous earth, forisil, attupulgus | |
| Resins and plastics | Ion-exchange only |
| Glass | |
| Quartz | |
| Titania gel | |
| Titanium dioxide | |
| Metallic oxides | |
| Zeolites (sieves) | |
| Zirconia gel | |
| Sil X | |
| Solid Support Materials Coated with Liquid adsorbers, preferably chemically bonded (e.g., chromatography Durapak, Solids Coated with Octadecyl Silane, Fluoro-ethers). | Commonly used in liquid-liquid partition |

Figure 9:
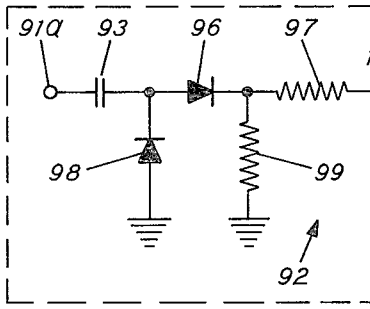
Figure 9:
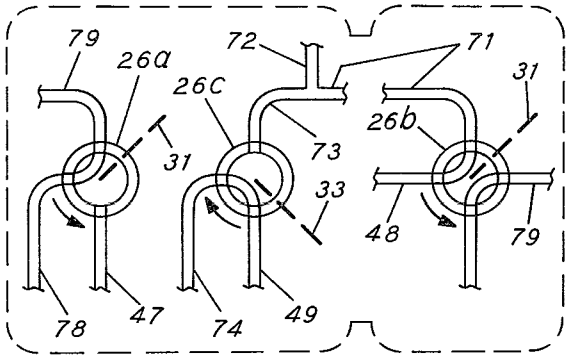

However, during operations of the adsorbent bed 44 as an adsorber of evaporative emissions, i.e., when control valve 26*c* assumes the position depicted in FIG. 9, the preferred polar classification of the material 53 should be reversed. Such assumption implies the requirement that the bed 44 employ capture materials which possess the most effective ratio of capture surface per unit volume of material. Accordingly, the adsorptive material 53 should also comprise, say as a second element thereof, a nonpolar component, say one selected from the following non-exclusive listing of nonpolar adsorbent materials in order to most effectively carry out the vapor capture aspect of the present invention.

| Nonpolar Adsorbent Material | Remarks |
|---|---|
| Charcoal | |
| Charcoal blacks | |
| Graphite | |
| Resins and Plastics | Organic only |
| Paraffins | |
| Stibnite | |
| Sulfides | Metallic only |
| Talc | |

In forming the composite be 44, the ratio, by volume, of polar to nonpolar material is preferably about 1:1. In some cases, however, the ratio can be varied to accommodate changed conditions, e.g., where the system of the present invention is used in the more humid climates of the world, there may be a need to use greater amounts of the nonpolar constituent to provide a larger emission capture area within the bed 44. Also, in other areas of the world as where cold start conditions are more severe, it may be advantageous to use greater amounts, by volume, of the polar material as the chief adsorbent component. However, since there can be a large overlap of both functions within certain known adsorbent materials, the adsorbent material 53 constituting adsorbent bed 44 can be likewise classified and need not be a dual-component mixture but can utilize a single component system provided it can perform in both the cold start and vapor capture functions, as outlined above.

Of course, the adsorbent material 53 can be formulated in a variety of ways for use within the cannister assembly 28. For example, the adsorbent bed 44 can be arranged in granular, pelletized or powdered form. Preparation is straight-forward: the adsorbent material should be calcined, acid and base washed, neutralized, and size graded prior to insertion within the housing 45, say along lines set forth in Kirk-Othmer, op. cit., Volume 1, page 460. Since as previously mentioned, during elution the flow rate of the full range gasoline within the bed must be slow enough to allow maximum transfer of the molecules of the heavier compounds into and from the stationary and mobile phases, the size of the polar component of the adsorbent material 53, if used, should be such as to minimize the pressure drop across a cannister assembly 28 without adversely affecting its ability to adsorb the heavier constituents. In this regard, an adsorbent bed 44 having about a 1-liter capacity can be filled with activated alumina (8 by 14 mesh) and such a bed has been found to adsorb from 200–300 ml of aromatic constituents while yielding about 400 to 500 ml of light molecular weight constituents for use in the first initial minutes of the cold starting operation.

Modification

Figure 4:
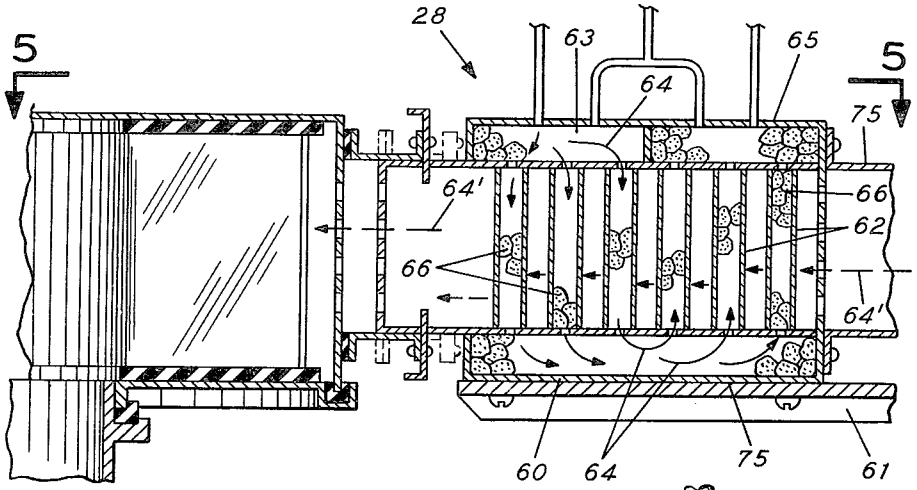
FIG. 4 is another embodiment of the present invention illustratng in side elevation a dual flow cannister assembly mounted, as by a platform to the firewall of the engine compartment.
Figure 3:
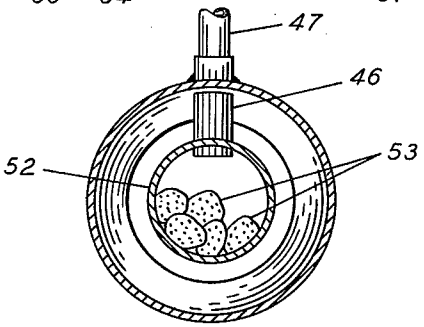
FIG. 3 is an end view taken along line 3—3 of the cannister assembly of FIG. 2.

In FIG. 4, the support of the cannister assembly 28 differs markedly from that shown in FIG. 1. The cannister assembly 28 of FIG. 4 is seen to be mounted by shell housing 60 to a platform 61 which in turn is attached to a firewall (not shown) of the engine compartment. Additional space afforded by the platform 61 allows for a more complex constructural design of the cannister assembly 28.

A series of upright tubular means 62 is constructed to carry the gasoline entering inlet chamber 63 along a series of sinusoidal passes through the interior of the cannister assembly 28, such passageways resembling those provided in a conventional tube-and-shell heat exchanger. The series of sinusoidal passes made by the gasoline are indicated by solid arrows 64 while the dotted arrows 64' indicate the direction of the air phase flow. In the depicted arrangement, tube-side gasoline is conveyed—during cold starting— through the tubular members 62 between the inlet and exhaust chambers 63 and 65 respectively (multipass percolation) through adsorbent material 66 packed within the tubular members 62 as well as within the chamber 63 and 65. Due to increased total length of the tubular members 62, the resulting adsorbent bed is likewise greatly enlarged over that depicted in FIGS. 1 and 2. The absolute length of the cannister assembly of FIG. 4 can be correspondingly reduced, if desired. Efficiency is also improved. At the exhaust chamber 65 the effluent has been found to consist essentially of low molecular weight liquid constituents to aid engine starting, as previously explained; also the heavier constituents remain adsorbed within the adsorbent material 66 until long after the engine has warmed up. That is to say, because the heavier constituents are retarded during percolation through the adsorbent material 66 for a longer time than required to usually start the engine, the effluent within the intake manifold per each starting cycle of the internal combustion engine is limited essentially to the lightweight, low molecular weight constituents.

Figure 5:
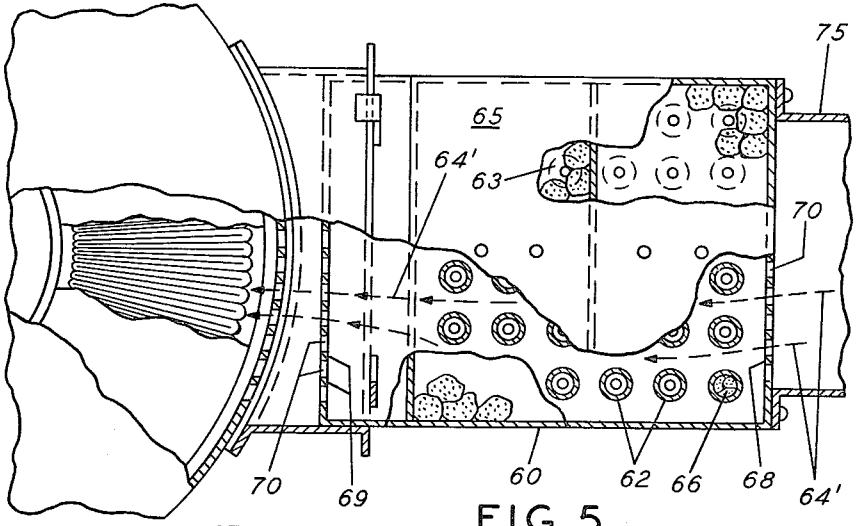
FIG. 5 is a top elevational view, partially cutaway, of the modified cannister assembly of FIG. 4.

Further constructural differences between the embodiments depicted in FIG. 1 and FIG. 4 are readily apparent. For example, in FIG. 5, the shell housing 60 is seen to be rectangular in cross-section whereby the assembly forms a parallelepipedon. Also, the shell housing 60 is also seen to include end walls 68 and 69. Each end wall 68 and 69 includes a series of ports 70 to allow selective entry of hot, exhaust gases adjacent to but generally exterior of tubular member means 62 within interior of shell housing 60. End wall 69 is also seen to attach by way of fasteners to the air cleaner housing. End wall 68 is seen to be connected to a conduit 75 having a remote end (not shown) connected to a source of exhaust gases, say the exhaust manifold of the engine.

Of course tubular members 62 need not be discontinuous so as require the use of intermediate chamber 76 (FIG. 4) to reverse the flow of the mobile phase; e.g., the tubular members 62 can be U-shaped with remote ends in fluid contact with inlet and exhaust chambers 63, 65, respectively.

Although the embodiment depicted in FIG. 1 utilizes intake air to the engine for purging of the cannister assembly, it should also be noted that the embodiment of FIG. 4 contemplates utilization of gases from the exhaust manifold for this purpose. In this regard, assume that the engine has been started and warmed using the full-range fuel, i.e., the inlet and outlet cold start valves **26*a* and 26*b* have been placed in the positions depicted in FIG. 8 so that the full-range fuel is free to directly enter the intake injector valves. Simultaneously with the utilization of the full-range gasoline, the adsorbent bed of the cannister assembly 28 is depressurized by the change in operating state of exhaust start valve 26*b* connecting the former to the intake manifold 11 of the engine. Note in FIG. 1 that the above-mentioned pressure flow is via fitting conduit 48, exhaust valve 26*b* and conduits 71 and 72 to intake manifold 11. In similar fashion the intake manifold 11 is placed in fluid contact with the vapor zone within the gas tank 21 since evaporative control valve 26*c* remains in an inoperative state. That is, the intake manifold 11 is placed via conduits 72, 73, evaporative valve 26*c*, and conduit 74, in fluid contact with the gas tank 21. In that way, as desorption of the heavier compounds within the cannister assembly can occur, say as warmed gases are conveyed in heat transfer contact with the adsorbent bed. These compounds are thereafter swept into the intake manifold, along with any evaporative emissions from the gas tank 21. It should also be pointed out that if evaporative vapors had been previously captured within the adsorptive bed of the cannister assembly, they would likewise be purged at this time, that is, with evaporative control valve 26c assuming the position depicted in FIG. 9** through the deactivation of the ignition switch.

Modification of the purging operation: in FIG. 4, the conveyance of the hot exhaust gases from the exhaust manifold is under control of additional electrical circuitry (not shown) of the fuel injection control circuit 15. When the temperature of the exhaust manifold reaches a selected temperature, a relay (not shown) is tripped to pass the purging gases through the cannister assembly 28 of FIGS. 4 and 5 via the conduit 75 previously mentioned. The desorbed materials within the adsorption bed of the cannister assembly 28 are ultimately consumed within the combustion chambers of the engine.

Where the heavier compounds within the adsorption bed of the cannister assembly have relatively high boiling points, too high in fact to be renewed by passing adjacent engine air in heat transfer contact with the elution zone, the embodiment depicted in FIG. 4 is especially useful. In this regard, the adsorbent material 66 of FIG. 4 can be renewed using the hot exhaust gases as the purging agent. If the temperature of such exhaust gases ranges from 700° to about 800°F, only a relatively short desorption time is required. Temperature of the adsorbent bed can be a range from 400°–500°F with about 450°F being a satisfactory operating temperature. Generally desorption time is quite short for such range setting, say being from about 2–12 minutes in duration. The resulting desorbed compounds then pass through the air intake system to the combustion chambers where they are consumed. Even though the cannister assembly 28 of FIG. 4 is larger than that depicted in FIG. 2, it provides better heat-transfer characteristics during desorption of the adsorption bed since the available heat transfer area (between the heat transferring media) is much larger. That is to say, the shell-side hot gases traveling through the cannister assembly 28 of FIG. 4 is in extremely good heat transfer contact with a multiplicity of the tubular member means. Also, since temperature of the gases is much higher, the total purge time can be reduced. However, the total flow rate of the hot purged gases at the air intake system should be carefully controlled so that the composite temperature of the inlet air to the intake manifold is not too hot for efficient utilization of the resulting air fuel mixture within the combustion chamber of the engine.

Figure 7:
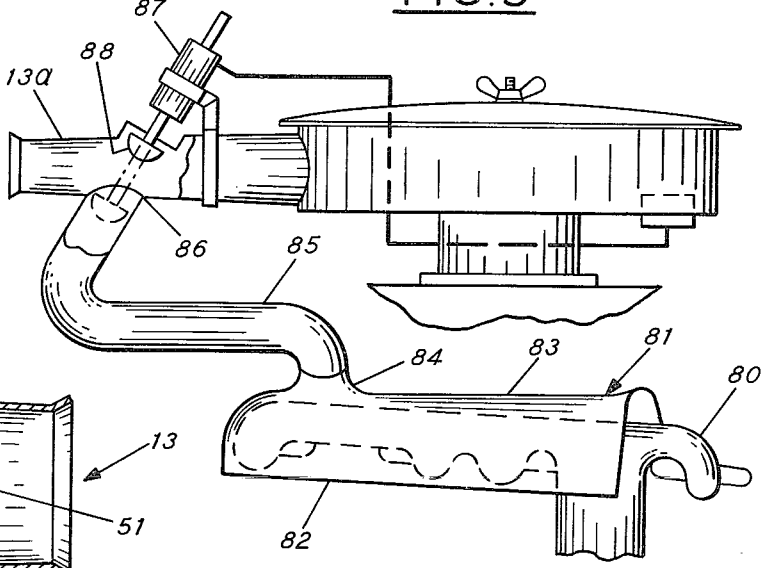
FIG. 7 is a partially schematic view illustrating an alternate embodiment by which air can be heated to an elevated temperature to better desorb the cannister assembly of FIG. 1.

FIG. 7 illustrates yet another mode for desorbing the adsorption bed of the cannister assembly of FIGS. 2 and 4 of the present invention. In accordance with the illustrated embodiment, engine air is heated by passing the air adjacent to exhaust manifold 80 and thence through the cannister assembly where desorption occurs. The exhaust manifold 80 itself is provided with an exterior hood 81 having lower skirts 82 which snuggly fit adjacent to the exhaust manifold, yet are open to incoming air. A central register 83 is also provided with a nozzle 84. Nozzle 84 in turn is attached by flexible conduit 85 connected at a port 86 say at the air intake line 13a of the air intake system. At the air intake line 13a, a solenoid operator 87 is positioned so that damper 88 is in register with port 86. Opening the damper 88 allows warmed engine air to enter the cannister assembly (not shown).

Sequence of Operations

Figure 8:
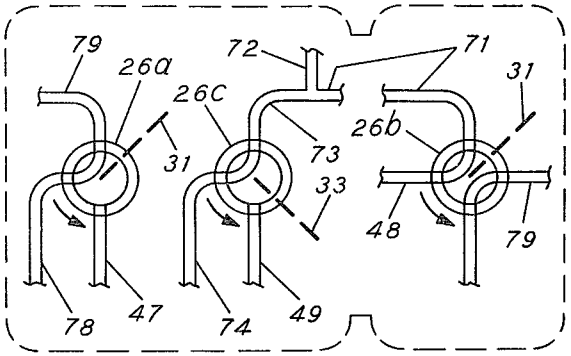
FIGS. 8 and 9 are fragmentary views of the valve and conduit network of FIG. 1 illustrating the position of the valve network in two positions: (i) after cold start has been achieved and the engine is at running temperature so that the cannister assembly can be desorbed by passing gases in heat transfer contact therewith; and (ii) after the engine has been placed in an inoperative state so that the cannister assembly is connected to the vapor zones of the fuel system (vapor capture cycle), respectively.

Reference should now be had to FIGS. 1, 2, 4–6, 8 and 9 illustrating the method aspects of the present invention. As previously mentioned, control injection control circuit 15 of FIG. 1 receives various sensory inputs indicative of various engine operating parameters after the circuit has been initialized. Of primary importance at cold start, is a signal indication of engine temperature, such signal appearing at the injection control circuit 15 of FIG. 6. Assume such signal is below a selected set point level, so that relay means 30 (FIG. 1) is activated as the driver closes ignition switch 35. The inlet and exhaust cold start valves 26a and 26b, as well as evaporative control valve 26c, are reoriented from the positions shown in FIG. 9 to those positions shown in FIG. 1. As the engine turns over, the pump 23 conveys full-range fuel through inlet start valve 26a to the cannister assembly 28. Within the cannister assembly 28, the full-range fuel passes through inlet start valve 26a to the cannister assembly 28. Within the cannister assembly 28, the full-range fuel percolates through the elution zone culminating in the elution of low molecular weight components at each of a series of injector valves 20. Heavier components of the full-range fuel remain adsorbed. From the injector valve 20, a metered amount of the lightweight components is conveyed into the mixing chamber 19 where the fuel and air are properly mixed and then convey for consumption within the combustion chambers of the engine. After selected rise in the engine temperature, as indicated at terminal 90 of FIG. 6, relay means 30 becomes deactivated, resulting in the cold start inlet and exhaust valves 26a and 26b returning to relaxed positions as shown in FIG. 8.

After cold start exhaust and inlet valves 26a and 26b return to relaxed positions depicted in FIG. 8, the fuel intake system switches over to full utilization of the full-range gasoline. That is to say, fuel conveyed from pump 23 of FIG. 1 passes to inlet cold start valve 26a via conduit 78 and thence from the valve 26a through conduit 79 and exhaust cold start valve 26b into the injector valve 20 as a function of control signals provided in fuel injection control circuit 15.

Figure 6:
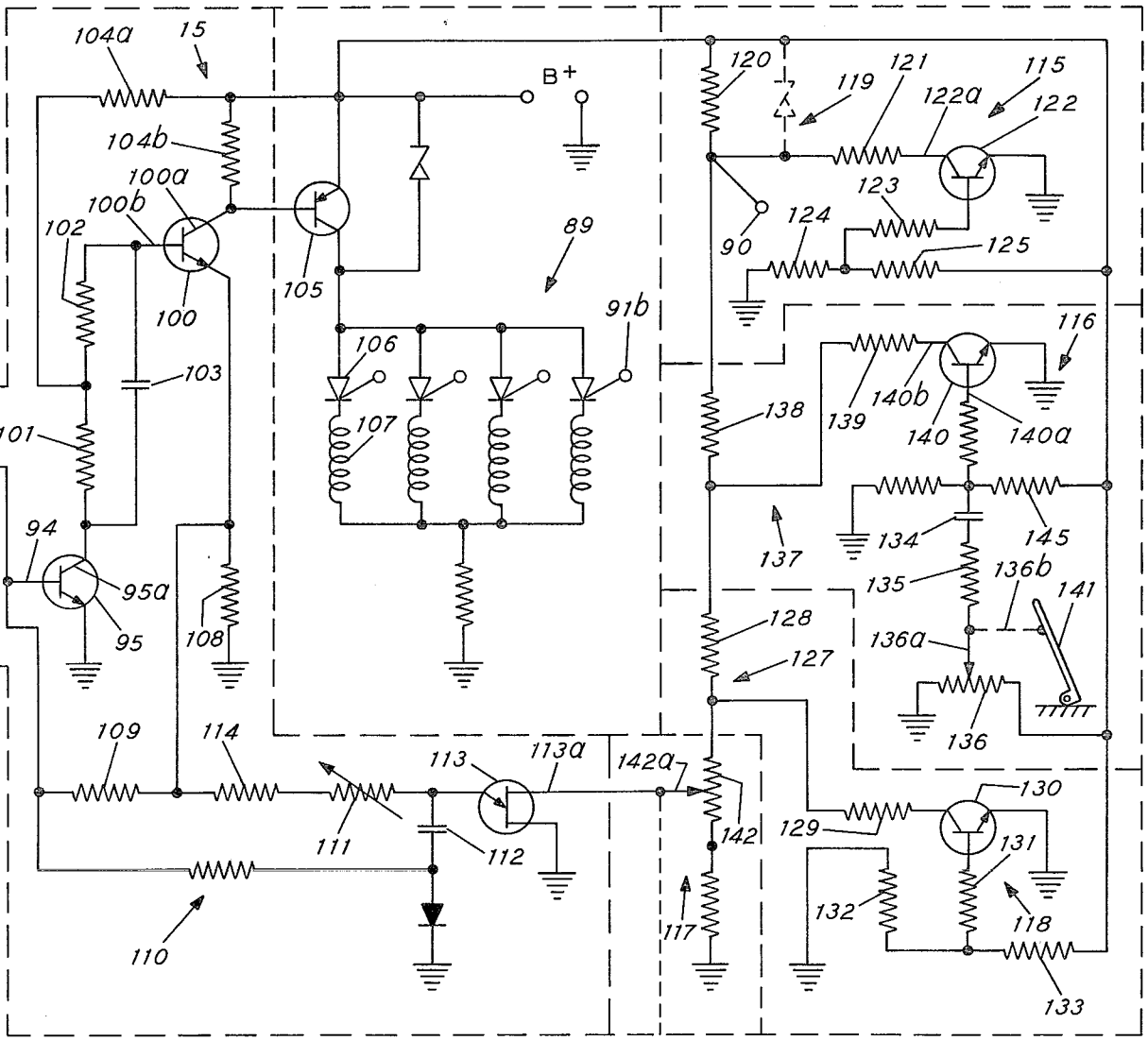
FIG. 6 is a circuit diagram of the fuel injection control circuit of FIG. 1, illustrating how the injection cycle and cold start cycle are interrelated.

FIG. 6 illustrates the operation of fuel injection control circuit 15 in detail.

As indicated, the control circuit 15 is energized by a voltage supply designated as B+, as noted. In the application of this system to an automobile, the voltage supply B+ can be a battery and/or a battery charging system and additionally can provide a polarity readily reversed from that illustrated.

As explained previously, the control circuit 15 through designated circuit elements receives the following sensory inputs indicative of engine operating parameters.

| Parameter | Signal Source (FIG. 1) | Operational Circuitry (FIG. 6) |
|---|---|---|
| Manifold pressure | Sensor 18 | Control Circuit 110 |
| Engine temperature | Sensor 36 | Engine temperature circuit 115 |
| Acceleration | Travel Sensor 37 | Acceleration circuit 116 |
| Engine Speed | Transducer 38 | Speed circuit 117 |
| Air Temperature | Sensor 16 | Air Temperature circuit 118 |
| Shaft Angle | Transducer | — |

-continued

| Parameter | Signal Source (FIG. 1) | Operational Circuitry (FIG. 6) |
|---|---|---|
| | 38 | |

In essence, the control circuit 15 generates a plurality of control pulses, the width of which is linearly variable with a fundamental parameter, namely, the manifold pressure of the engine, as well as being capable of being stretched or diminished by remaining engine parameters. In order to initiate operations, as the driver closes the ignition switch 35, a pulse generator (not shown) is energized. The pulse generator (not shown) is connected to the input terminal 91*a* of multivibrator circuit 92 via shaft angle transducer 38. In that way, the pulse generator is operative as a function of shaft angle so as to synchronize operation of the bistable multivibrator circuit 92 with angular position of the shaft of the engine. To provide similar synchronizing operations relative to particular injector valve 20, the pulse generator also provides (via transducer 38) a pulse signal at input terminal 91*b* of injection valve circuit 89.

As shown in detail in FIG. 6, multivibrator circuit 92 includes a coupling capacitor 93 in series with base 94 of transistor 95 via diode 96 and resistor 97. Shunting the couping capacitor 93 is a second diode 98 (through which the capacitor 93 can be discharged) and a resistor 99.

A start pulse received at base 94 of transistor 95 from the pulse generator, will trigger the multivibrator circuit into its unstable state, i.e., transistor 95 into a conducting state. Mating transistor 100 of the multivibrator circuit is base connected via base 100*b* to collector 95*a* of the transistor 95 through a network comprising resistors 101 and 102 and capacitor 103. As transistor 95 conducts, the transistor 100 is caused to assume a voltage below its conduction state. However, voltage at collector 100*a* of the transistor 100 will rise toward the B+ value, and that value will be communicated via resistors 104*a* and 104*b* to power transistor 105. The power transistor 105 in conjunction with an adjacent resistor network acts as a current source, and current is passed through thyristors 106 and coil 107 of one of a series of injector system 89.

It should be apparent that at each injector coil 107, selection is controlled through coordination of angular position of the shaft of the engine as provided by transducer 38. In that way, synchronization of the time of appearances of the control pulses provided by the pulse generator at the individual terminal 91*b* with the time of energization of the multivibrator circuit 92.

After the transistor 105 conducts, transistor 100 is rapidly triggered into conduction as voltage at its base 100*b* (as determined by the adjacent RC network) decays to the value needed for the multivibrator circuit to relax. As a result, transistor 95 is biased off, but it is quickly returned to a conducting state as the transistor 100 is biased off. To return the transistor 95 to a conducting state, it should be apparent that as conduction of transistor 100 occurs it acts in cooperation with a voltage supply and adjacent resistors 108 and 109 to form a current source to provide a base current to transistor 95 and causes the transistor 95 to conduct. The rate of switching between the transistors 95 and 100 is rapid enough that it does not affect operation of power transistor 105. That is, even though the multivibrator circuit is undergoing rapid switching of transducer 95 and 100, the power transistor 105 remains in a conducting state. However, the multivibrator circuit 92 can be made to relax to its stable state upon the receipt of a negative pulse at the base 94 of transistor 95, such negative pulse being generated by a separate control circuit 110.

Control circuit 110 is seen to include variable resistor 111, condenser 112 and unijunction transistor 113 connected in parallel with base 94 of the transistor 95. When the voltage on the emitter of unitransistor 113 (provided via a RC network comprising resistors 111 and 114 and condenser 112), is equal to the voltage at its base 113*a*, the unitransistor 113 is energized causing a negative pulse to appear at base 94 of the transistor 95. The result: the multivibrator circuit 92 returns to a stable state. Voltage at the emitter of the unitransistor 113 is seen to be determined by the time constant of the aforementioned RC network, while the voltage appearing at base 113*a* is a function of composite voltage generated from the following control circuits, (i) engine temperature circuit 115, (ii) acceleration circuit 116, (iii) speed circuit 117 and (iv) air temperature circuit 118.

Engine temperature circuit 115 operates to increase pulse width as a function of temperatue, but the temperature which causes circuit 115 to become operative must be below a selected point level, as explained below. Temperature circuit 115 is seen to include a voltage divider 119 formed by resistors 120, 121 and transistor 122. Assume the transistor 122 is conducting, i.e., resistor network 123, 124 and 125 at its base, connect to the voltage supply B+ as shown. As the transistor 122 conducts, the change in voltage at the collector 122*a* is seen to be a direct indication of engine temperature. In other words, the change in voltage of the collector 122*a* of the transistor 122 is reflected by the voltage divider 119 which in turn is reflected by a change in voltage at base 113*a* of unitransistor 113.

To provide a selected set point level for operation of the temperature circuit 115, the resistors 123, 124 and 125 are chosen such that the transistor 122 saturates at a given engine temperature providing a balanced condition at voltage divider 119.

Air temperature circuit 118 operates in a similar manner as the engine temperature circuit 115. As indicated, a voltage divider 127 is formed by resistors 128 and 129 and transistor 130. As previously, voltage at the base of the transistor 130 is controlled by base resistors 131, 132 and 133 connected to the supply B+. The air temperature is indicated by the internal resistance of the transistor 130 as reflected in change in collector voltage.

Acceleration circuit 116 is seen to include capacitor 134, resistor 135 and potentiometer 136 which operates in cooperation with a voltage divider 137 comprising resistors 138, 139 and transistor 140. Arm 136*a* of the potentiometer 136 is seen to connect via transducer 136*b* to the butterfly valve of the engine via accelerator pedal 141. Thus movement of the pedal 141 causing displacement of the wiper arm 136*a* changes the bias voltage appearing at base 140*a* of the transistor 140. Assume that the transistor 140 has been driven into conduction, but the voltage divider 137 formed therewith is unbalanced. Thus, the change brought about by the movement of the arm 136*a* will cause a change in the collector voltage at collector 140*b* as a function of pedal movement. The operation of the acceleration circuit 116 occurs during a variable time period dependent upon the time constant of the resistors 135, 145, the potentiometer 136 as well as capacitor 134.

Speed circuit 117 is for the purpose of correcting for a lag time of air flow into the engine. Aerodynamic effects lead to a decrease in the rate of air intake as a function of increasing engine speed. Circuit 117 includes a potentiometer 142 having an arm 142*a* connected by a transducer 142*b* to a tachometer (not shown) operative when a set point level is exceeded to change the voltage level at the base 113*a* of unitransistor 113 in the manner previously described.

Now returning to the embodiment depicted in FIG. 1 under control of the fuel injection control circuit 15 of FIG. 6, it is apparent that controls are there shown which, after the engine has started and warmed and utilization of the full range fuel occurs via reorientation of cold start valves 26*a* and 26*b* to the positions shown in FIG. 8, the elution zone of the cannister assembly 28, as well as the vapor zone of gas tank 21, are placed in fluid contact with the intake manifold 11. In that way, as desorption of the heavier compounds occurs, say as warmed gases are conveyed in heat transfer contact with the elution zone and the heavier compounds are swept into the intake manifold 11, there can be a simultaneous conveyance of evaporative emissions, if any, from the gas tank 21 to the manifold 11. With the desorption of heavier compounds within the elution zone, it should also be pointed out that vapors previously captured within the same zone are likewise purged. It should be recalled with reference to FIG. 9 that such vapors were conveyed to the aforementioned zone via conduits 49, 74 and control valve 26*c*. During desorption, both types of desorbed materials enter the manifold 11 in the manner previously described.

While the certain preferred embodiments of the invention have been specifically disclosed above, it should be understood that the invention is not limited thereto as many variations will be readily apparent to those skilled in the art and thus the invention is to be given the broadest possible interpretation within the terms of the following claims.

I claim:

1. In a high fuel injection system for a spark-ignition combustion engine of the type having a shaft, one or more cylinders each having an injector valve responsive to a control signal for injecting and mixing a predetermined quantity of full-range fuel with air to form a combustible mixture for delivery to such cylinders of said engine, and computing means including synchronizing and condition means for controlling and generating said control signals as a function of one or more engine operating parameters, said synchronizing means being operatively connected to said injection valves for synchronizing operation thereof as a function of predetermined angular position of said shaft by generating a correctly timed start signal for each of said injector valves, said condition means responsive to each of said start signals as well as to signals indicative of other operating parameters, for controlling the duration of energization of said each of said injection valves, the improvement for reducing exhaust pollutants of said engine by (i) dynamically varying the composition of said full-range fuel during cold starting of said engine (cold start cycle), and alternatively (ii) adsorbing evaporative emissions originating from vapor zones within fuel system at least during an inoperative state of said engine, comprising:

i. cannister means selectively connectable between said injection valves and a reservoir of said full-range fuel including an adsorption bed of adsorbent material, ii. control means for controlling fluid flow including liquid fuel and vapor emission and flow between said reservoir means, said cannister means and said injection valves as a function of at least one of several engine operating parameters, iii. said control means including at least first and second precondition means for alternatively (i) initiating, during said cold start cycle, flow of said full-range fuel from said reservoir to said cannister means and hence over said adsorption led so as to elute a cold start fuel effluent composed essentially of low molecular weight liquid constituents, said effluent being passed to said injection valves in sufficient amounts to assure starting of said engine, and (ii) permitting flow of evaporation vapors from said vapor zones of said fuel system to said same adsorption bed for capture thereon during, at least, said inoperative state of said engine.

2. The improvement of claim 1 in which said first precondition means is further characterized by first and second valve means operative after said engine has started and warmed, to place said reservoir of fuel-range fuel in direct liquid flow contact with said injection valves, at least one of said valve means being operative to also cause depressurization of said cannister means so as to allow purging of adsorbents within said adsorbent bed of adsorbent material for ultimate consumption within said engine.

3. The improvement of claim 1 in which said adsorbent material is selected so as to provide dual functions of:

i. efficient retardation of high molecular weight constituents of said full-range fuel percolating therethrough whereby essentially only low molecular weight constituents are eluted from said cannister means during cold starting of said engine, and (ii) effective capture of evaporative emissions originating from said vapor zones of said fuel system during, at least, said inoperative state of said engine.

4. Apparatus for reducing exhaust and inoperative pollutants produced by a high speed injection system for a spark-ignition internal combustion engine for the type including a rotating shaft, one or more cylinders each having an injection valve responsive to a control signal for injecting and mixing a predetermined quantity of full-range fuel with air to form a combustible mixture for delivery to said cylinders of said engine, and computing means including synchronization and precondition means for controlling said injection valves through generation of said control signals as a function of one or more engine operating parameters, said synchronizing means being operatively connected to each of said injection valves for synchronizing operation thereof as a function of predetermined angular shaft position by generating a series of start signals for said injector valves, said precondition means responsive to each of said start signals as well as to signals indicative of other operating parameters, for controlling the duration of energization of said injection valves, comprising:

i. a cannister assembly containing adsorbent material (a) capable of selectively adsorbing high molecular weight constituents of said full-range fuel at cold start so as to provide substantially unimpeded elution of a cold start fuel effluent composed essentially of only low molecular weight constituents as well as (b) capable of selectively absorbing vapor constituents of said full-range fuel at least during an inoperative state of said engine, ii. valve and conduit network means attached between said cannister assembly and a reservoir means for said full-range fuel for providing selective flow of said fuel including said cold start fuel between said cannister assembly, said reservoir means and each of said injector valves, said network means including a plurality of conduit and valve means including a multiplicity of valve means controlling flow relative to said cannister assembly so as to allow, (a) in a first operating state, flow of said full-range fuel from said reservoir means over said adsorbent bed to generate said cold start effluent as well as flow of said cold start fuel effluent from said cannister assembly to said each injector valve to provide for rapid starting of said engine without producing excessive exhaust pollutants and (b) in a second operating state, full-range fuel of flow directly from said reservoir means to said each injector valve in sequence thereby bypassing said cannister assembly after said engine is in a normal running conditions, while simultaneously allowing for depressurization of said adsorbent bed, iii. said plurality of conduit and valve means also including separate valve means operatively connected between said adsorbent bed and a vapor zone of said fuel reservoir means for selectively conveying vapor evaporative emissions originating from within said fuel reservoir to said same adsorbent bed when said engine is in said inoperative state, iv. control means operatively connected to said valve means of said valve and conduit network for changing operation states so as to direct fuel flow relative to said cannister assembly, said reservoir and injector valves as a function of one or more engine operating parameters.

5. Apparatus of claim 4 in which said cannister assembly includes an enlarged cylindrical shell housing terminating in first and second end pole pieces and including a plurality of radically extending couplings extending through said housing, said plurality of couplings being connected to said reservoir means, and said adsorbent bed, through said valve means, including said multiplicity of valve means as well as said separate valve means, whereby (i) in first operating state, to allow direct delivery of fuel to said injection valves as a function of a selected engine parameter and (ii) in a second operating state to allow selective vapor contact therebetween whereby evaporative emissions from said reservoir means can be adsorbed within said same adsorbent bed and thereby not escape into said surrounding atmosphere.

6. Apparatus of claim 4 in which said cannister assembly includes a multiplicity of tubular conduits each arranged parallel to each other within a single tubular shell housing, each conduit supporting a segment of said bed of adsorbent material but all terminating at central inlet and outlet chambers in operative contact with said valve means so as to provide said dual functions of: (i) cold start elution of low molecular weight cold start constituents and (ii) capture of evaporative emissions originating from said fuel system along sinusoidal paths within said single enlarged housing.

7. Apparatus of claim 6 in which said pole pieces are perforated, one thereof being connected by air intake control means including conduit means to a source of heated gas, so as to allow selective flow of said heated gas through said cannister assembly for purging said adsorbent bed with adsorbed cold start constituents and evaporative emissions as a function of a function of a selected engine parameter, said purged constituents from said adsorbent bed being carried into and consumed within said combustion chambers of said engine during normal running operation thereof.

8. Process for reducing formation of exhaust pollutants at cold start of a fuel-injection, spark-ignition internal combustion engine of the type having a fuel system, a shaft, one or more cylinders each having an injector valve responsive to a control signal for injecting and mixing a full-range fuel of said fuel system and air to form a combustible mixture for delivery to said cylinders without affecting full-range engine performance after cold starting has been concluded while simultaneously providing for effective capture of evaporative emissions originating from vapor zones of said fuel system when said engine is in an inoperative state, comprising the steps of:

i. during said cold start cycle, dynamically eluting from a full-range fuel passing through an adsorbent bed of absorbent material, a cold start fuel composed essentially of low molecular weight constituents, ii. mixing said low molecular weight constituents with air at each of said injection valves to form an enriched fuel air mixture for delivery to combustion chambers of said engine during cold start where consumption without undue formation of exhaust pollutants occurs, iii. terminating elution of said cold start fuel after said engine has started, iv. switching flow of said full-range fuel directly to said each injection valve by bypassing liquid fuel flow with respect to said absorbent bed, v. after said engine has attained a normal running condition as indicated by a selected engine parameter, purging with heated fluid said adsorbent bed of adsorbates, vi. conveying said purged higher molecular weight constituents into said combustion chambers of said engine, and vii. after said engine has been placed in said inoperative state, opening vapor conduit means between said same adsorbent bed, and a reservoir of said full-range fuel whereby any vapor emissions originating from within said fuel system are captured within said same adsorbent bed and thereby prevented from escaping into the atmosphere surrounding said engine.

9. The process of claim 8 in which step (i) of elution of said low molecular weight constituents is further characterized by passing said full range fuel over an adsorbent bed formed of polar adsorbent material so as to provide improved retardation of said high molecular weight constituents vis-a-vis said low molecular weight constituents at cold starting of said engine.

* * * * *